US005407347A

United States Patent [19]

Bortz

[11] Patent Number: 5,407,347

[45] Date of Patent: Apr. 18, 1995

[54] APPARATUS AND METHOD FOR REDUCING $NO_x$, CO AND HYDROCARBON EMISSIONS WHEN BURNING GASEOUS FUELS

[75] Inventor: Steven J. Bortz, Laguna Niguel, Calif.

[73] Assignee: Radian Corporation, Austin, Tex.

[21] Appl. No.: 188,586

[22] Filed: Jan. 27, 1994

Related U.S. Application Data

[63] Continuation-in-part of Ser. No. 92,979, Jul. 16, 1993, abandoned.

[51] Int. Cl.[6] ..... F23M 9/00

[52] U.S. Cl. ..... 431/183; 431/116; 431/285; 431/354

[58] Field of Search ..... 431/5, 115, 116, 8, 431/9, 283, 284, 285, 183, 181, 188, 354, 351

[56] References Cited

U.S. PATENT DOCUMENTS

| | | | |
|---|---|---|---|
| 3,115,924 | 12/1963 | Massier | 431/284 |
| 3,227,202 | 1/1966 | Morgan | 431/285 |
| 3,358,736 | 12/1967 | Reed et al. | 431/285 |
| 3,749,548 | 7/1973 | Zink et al. . | |
| 3,775,039 | 11/1973 | Pillard . | |
| 3,788,065 | 1/1974 | Markowski . | |
| 3,811,277 | 5/1974 | Markowski . | |
| 4,083,674 | 4/1978 | Holzanpfel . | |
| 4,094,625 | 6/1978 | Wang et al. . | |
| 4,130,389 | 12/1978 | Kaboragi et al. . | |
| 4,155,701 | 5/1979 | Primas . | |
| 4,160,640 | 7/1979 | Maev et al. . | |
| 4,221,558 | 9/1980 | Santisi . | |
| 4,230,445 | 10/1980 | Janssen | 431/351 |
| 4,297,093 | 10/1981 | Morimoto et al. . | |
| 4,451,230 | 5/1984 | Bocci et al. . | |
| 4,479,775 | 10/1984 | Wiesel . | |
| 4,600,377 | 7/1986 | Musil . | |
| 4,701,124 | 10/1987 | Maghon . | |
| 4,842,509 | 1/1989 | Hasenack . | |
| 4,884,555 | 12/1989 | Huang . | |
| 4,899,670 | 2/1990 | Hansel . | |
| 4,943,230 | 7/1990 | Shekleton . | |
| 5,000,679 | 3/1991 | Fukuda et al. . | |
| 5,009,174 | 4/1991 | Polak . | |
| 5,029,557 | 7/1991 | Korenberg . | |
| 5,062,792 | 11/1991 | Maghon . | |
| 5,085,577 | 2/1992 | Muller . | |
| 5,092,762 | 3/1992 | Yang et al. . | |
| 5,101,633 | 4/1992 | Keller et al. . | |
| 5,135,387 | 8/1992 | Martin et al. . | |
| 5,147,199 | 9/1992 | Perthuis et al. . | |
| 5,161,946 | 11/1992 | Bortz et al. . | |
| 5,169,304 | 12/1992 | Flament et al. . | |
| 5,186,607 | 2/1993 | Yang et al. . | |
| 5,192,204 | 3/1993 | Musil . | |
| 5,240,410 | 8/1993 | Yang et al. . | |

*Primary Examiner*—James C. Yeung
*Attorney, Agent, or Firm*—Klauber & Jackson

[57] ABSTRACT

A forced draft burner apparatus and method providing extremely low $NO_x$, CO and hydrocarbon emissions, while maintaining the desirable features of a nozzle mix burner. This is accomplished by injecting the fuel gas in a position that would be typical for a nozzle mix burner, while generating such rapid mixing that, effectively, premixed conditions are created upstream of the ignition point.

24 Claims, 8 Drawing Sheets

CALCULATED $NO_x$ VS. ADIABATIC FLAME TEMPERATURE FOR A PREMIXED FLAME WITH 15% EXCESS AIR

KINETIC CALCULATION OF PROMPT $NO_x$ ($HCN + NH_3$)

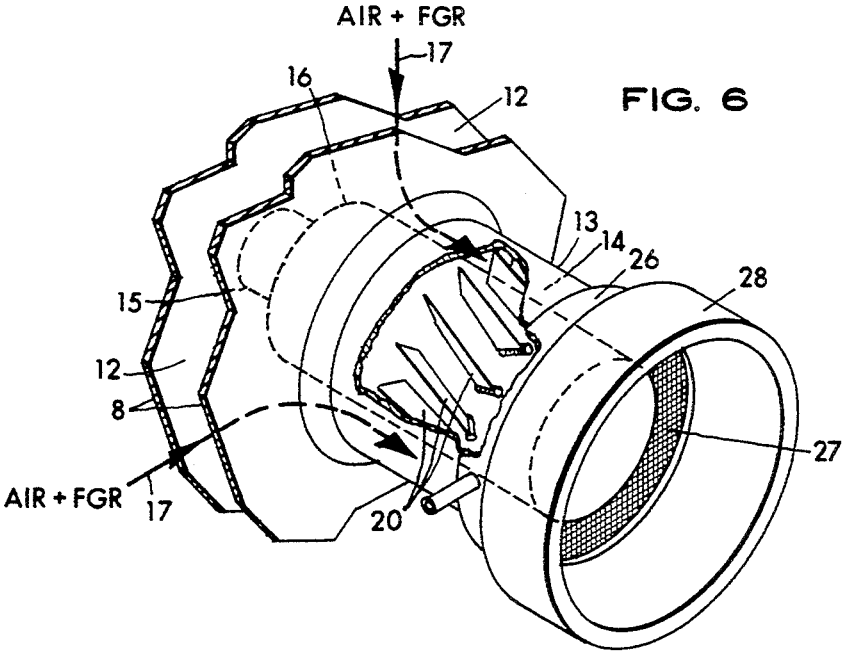
FIG. 6
FIG. 7
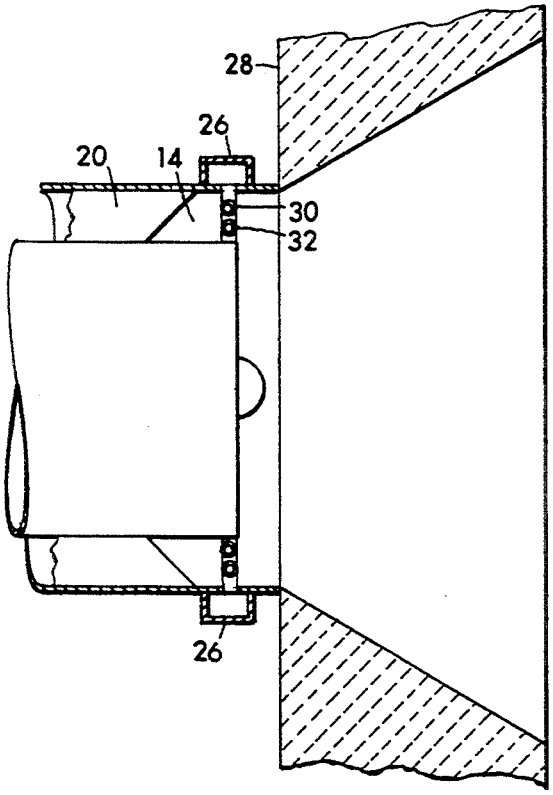
FIG. 7A
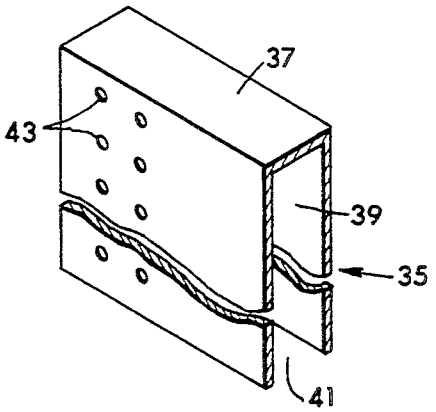

MEASURED EFFECT OF MIXING RATE ON $NO_x$ EMISSIONS $NO_x$ VERSUS CO

CALCULATED EFFECT OF STOICHIOMETRY ON $NO_x$ FOR PREMIXED FLAMES

APPARATUS AND METHOD FOR REDUCING $NO_x$, CO AND HYDROCARBON EMISSIONS WHEN BURNING GASEOUS FUELS

RELATED APPLICATION

This application is a continuation-in-part of my application Ser. No. 08/092,979, filed Jul. 16, 1993, abandoned, and assigned to the assignee of the present application.

FIELD OF THE INVENTION

The invention relates generally to combustion apparatus, and more specifically relates to a burner that combines the advantageous operating characteristics of nozzle mix and premixed type burners to achieve extremely low $NO_x$, CO and hydrocarbon emissions.

BACKGROUND OF THE INVENTION $NO_x$ emissions from gas flames can be created either through the Zeldevitch mechanism (often called thermal $NO_x$) or through the formation of HCN and/or $NH_3$ which can then be ultimately oxidized to $NO_x$ (prompt $NO_x$). Thermodynamic calculations typically show that $NO_x$ emissions measured from natural gas flames are well below, one to two orders of magnitude, the thermodynamic equilibrium value. This indicates that in most situations $NO_x$ formation is kinetically controlled. Kinetic calculations indicate that thermal $NO_x$ emissions are typically the most important source of $NO_x$ for natural gas flames, with the $NO_x$ being created through the following reactions:

$$N+O_2=NO+O \quad (1)$$

$$N+OH=NO+H \quad (2)$$

$$N_2+O=NO+N \quad (3)$$

Kinetic calculations were performed using a PC version of the CHEMKIN computer program. Calculations using this program have provided valuable insight into changes in the burner fuel and air mixing characteristics which can lower $NO_x$ emissions.

As the name implies, thermal $NO_x$ can be controlled by regulation of the peak flame temperature, and as shown in FIG. 1 using kinetic calculations, if the temperature can be lowered enough the $NO_x$ emissions from a "true" premixed natural gas flame operating at 15% excess air can be reduced to extremely low values (less than 1 ppmv). In effect FIG. 1 shows the relationship between thermal $NO_x$ and temperature since for a premixed natural gas flame with an excess of oxygen, thermal $NO_x$ is the only route by which any significant $NO_x$ emissions are created.

Under appropriate flame conditions the formation of prompt $NO_x$ can also be important when burning natural gas. The kinetic model used shows that under fuel rich conditions, particularly when the stoichiometry is under about 0.6, both HCN and $NH_3$ can be formed through reaction of CH with $N_2$ to form HCN and N. These calculations were conducted using gas and air mixtures with stoichiometries ranging from 1.0 to 0.4. The model predicts that prompt $NO_x$ becomes important at higher stoichiometries when the temperature is lower; see FIG. 2. Below a stoichiometry of 0.5 almost all the $NO_x$ formed is prompt $NO_x$. The rate of prompt $NO_x$ formation (as the name implies) is also very rapid, being nearly complete in about 1 millisecond at a temperature of 2400° F.

Kinetic calculations also indicate that hydrocarbon fragments, in addition to being important for prompt $NO_x$, are also important for thermal $NO_x$ formation since they can act as a source of O atoms and OH radicals. Kinetic calculations show the importance of the hydrocarbon concentration in the formation of $NO_x$, even under oxidizing conditions. At a temperature of 3400 ° F. the predicted $NO_x$ emissions were about 4 ppmv after 5 ms residence time for a mixture of $N_2$, $O_2$, $H_2O$, and $CO_2$ when hydrocarbons were not present, as compared to 80 ppmv when combustion of about 1% $CH_4$ was present in the gas mixture. If the concentration of methane initially present was reduced to about 0.5%, the $NO_x$ concentration after 5 ms was reduced to about 75 ppmv. The kinetic model used predicts that the following mechanisms are important:

1. Reaction of $CH_4$ with $O_2$, OH and H to form $CH_3$
2. Reaction of $CH_3$ with $O_2$ to form $CH_3O$ and O
3. Reaction of $N_2$ with O to form NO and O
4. Various reactions to form OH
5. Reaction of $N_2$ with OH to form NO and NH Low $NO_x$ gas burners have been undergoing considerable development in recent years as governmental regulations have required burner manufacturers to comply with lower and lower $NO_x$ limits. Most of the existing low $NO_x$ gas burner designs are nozzle mix designs. In this approach the fuel is mixed with the air immediately downstream of the burner throat. These designs attempt to reduce $NO_x$ emissions by delaying the fuel and air mixing through some form of either air staging or fuel staging combined with flue gas recirculation ("FGR"). Delayed mixing can be effective in reducing both flame temperature and oxygen availability and consequently in providing a degree of thermal $NO_x$ control. However, delayed mixing burners are not effective in reducing prompt $NO_x$ emissions and can actually exacerbate prompt $NO_x$ emissions. Delayed mixing burners can also lead to increased emissions of CO and total hydrocarbons. Stability problems often exist with delayed mixing burners which limit the amount of FGR which can be injected into the flame zone. Typical FGR levels at which current burners operate are at a ratio of around 20% recirculated flue gas relative to the total stack gas flow.

A further type of low $NO_x$ burner which has been developed in recent years is the premixed type burner. In this approach, the fuel gas and oxidant gases are mixed well upstream of the burner throat, e.g. at or prior to the windbox. These burners can be effective in reducing both thermal and prompt $NO_x$ emissions. However, problems with premixed type burners include difficulty in applying high air preheat, concerns about flashback and explosions, and difficulties in applying the concept to duel fuel burners. Premix burners also typically have stability problems at high FGR rates.

SUMMARY OF INVENTION

Now in accordance with the present invention, extremely low $NO_x$, CO and hydrocarbon emissions are achieved, while maintaining the desirable features of a nozzle mix burner. Pursuant to the invention, this is accomplished by injecting the fuel gas, such as natural gas, in a position that would be typical for a nozzle mix burner, while generating such rapid mixing that, effectively, premixed conditions are created upstream of the ignition point.

In burner apparatus in accordance with the invention an outer shell is provided which includes a windbox and a constricted tubular section in fluid communication therewith. A generally cylindrical body is mounted in the shell, coaxially with and spaced inwardly from the tubular section so that an annular flow channel or throat is defined between the body and the inner wall of the tubular section. Oxidant gases are flowed under pressure from the windbox to the throat, and exit from a downstream outlet end. A divergent quarl is adjoined to the outlet end of the throat and define a combustion zone for the burner. A plurality of curved axial swirl vanes are mounted in the annular flow channel to impart swirl to the oxidant gases flowing downstream in the throat. Fuel gas injector means are provided in the annular flow channel proximate or contiguous to the swirl vanes for injecting the fuel gas into the flow of oxidant gases at a point upstream of the outlet end. The fuel gas injection means comprise a plurality of spaced gas injectors, each being defined by a gas ejection hole and means to feed the gas thereto. The ratio of the number of gas ejection holes to the projected (i.e. transverse cross-sectional) area of the annular flow channel which is fed fuel gas by the injector means is at least 200 /ft$^2$.

One or more turbulence enhancing means may optionally be mounted in the throat at at least one of the upstream or downstream sides of the swirl vanes. These serve to induce fine scale turbulence into the flow to promote microscale mixing of the oxidant and fuel gases prior to combustion at the quarl.

The gas injectors can be located at the leading or trailing edges of the swirl vanes, and inject the fuel gas in the direction of the tangential component of the flow imparted by the swirl vanes. The gas injectors can also be disposed on a plurality of hollow concentric rings which are mounted in the throat downstream of the swirl vanes. The injected can similarly comprise openings disposed in opposed concentric bands on the walls which define the inner and outer radii of the annular flow channel. The gas injectors can also be located at the surfaces of the swirl vanes, with the vanes being hollow structures fed by a suitable manifold.

Preferably the geometry of the burner is such that the product of the swirl number S and the quarl outlet to inlet diameter ratio C/B is in the range of 1.0 to 3.0.

Pursuant to another aspect of the invention, a method is provided for injection of gaseous fuel in a forced draft burner of the type which includes an annular throat of outer diameter B, having an inlet connected to receive a forced flow of air and recirculated flue gases, and an outlet adjoined to a divergent quarl. The gaseous fuel is injected at an axial coordinate which is spaced less than B in the upstream direction from the axial coordinate at which the quarl divergence begins; and sufficient mixing of the gaseous fuel with the air and recirculated flue gases is provided that these components are well-mixed down to a molecular scale at the axial coordinate of ignition. This procedure results in extremely low $NO_x$, CO and hydrocarbon emissions from the burner.

In a still further aspect of the invention, the swirl vanes, which are mounted with their leading edges parallel to the axial flow of fuel and oxidant gases, and then slowly curve to the final desired angle, have a constant radius of curvature along the curved portion of the vane, whereby the curved portion is a section of a cylinder. This shape simplifies manufacturing using conventional metal fabricating techniques.

BRIEF DESCRIPTION OF DRAWINGS

The invention is diagrammatically illustrated, by way of example, in the drawings appended hereto in which:

FIG. 6 is a perspective view of the apparatus of FIG. 5;

FIG. 7 is a cross-sectional schematic view similar to FIG. 4 and showing a further arrangement for the fuel gas injection means;

FIG. 7A is a simplified partially sectional perspective view of a portion of a swirl vane, showing a further arrangement for the fuel gas injection means;

DESCRIPTION OF PREFERRED EMBODIMENTS

Figure 1:
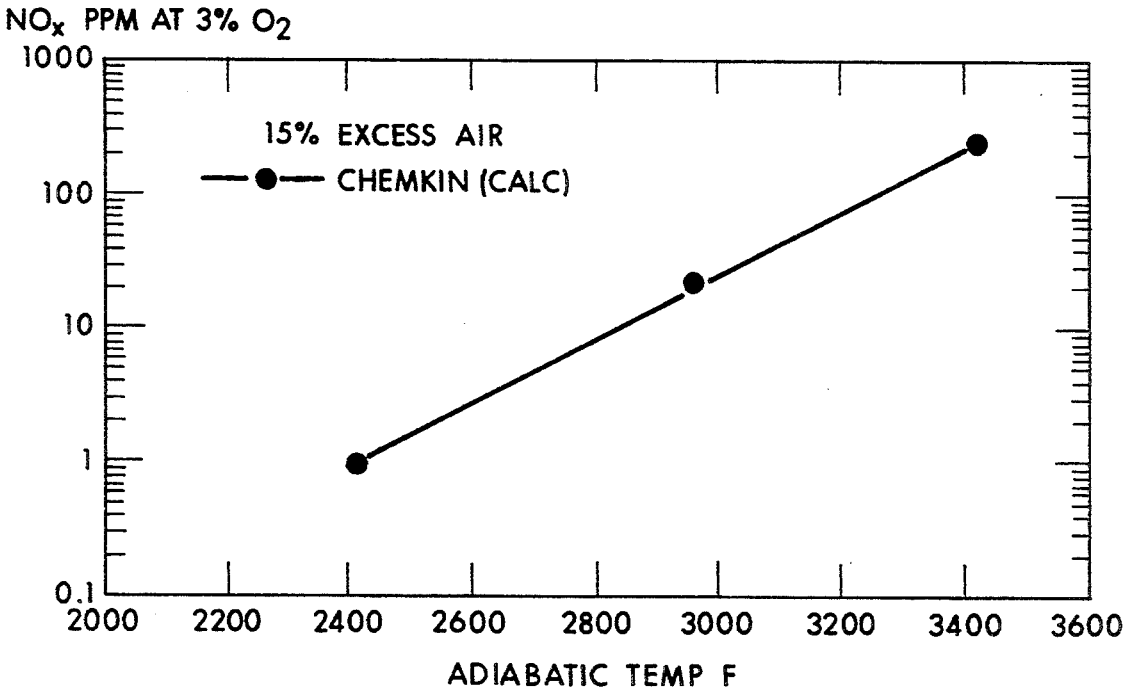
FIG. 1 is a graphical depiction showing calculated $NO_x$ versus adiabatic flame temperature for a premixed flame with 15% excess air.
Figure 2:
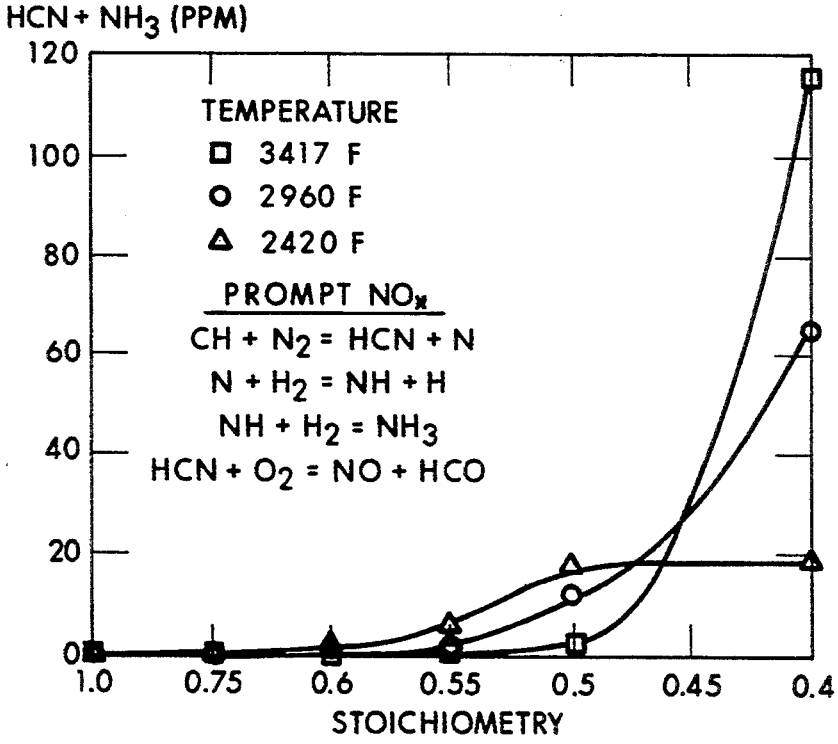
FIG. 2 is a further graph showing kinetic calculation of prompt $NO_x$ (HCN and $NH_3$)
Figure 3:
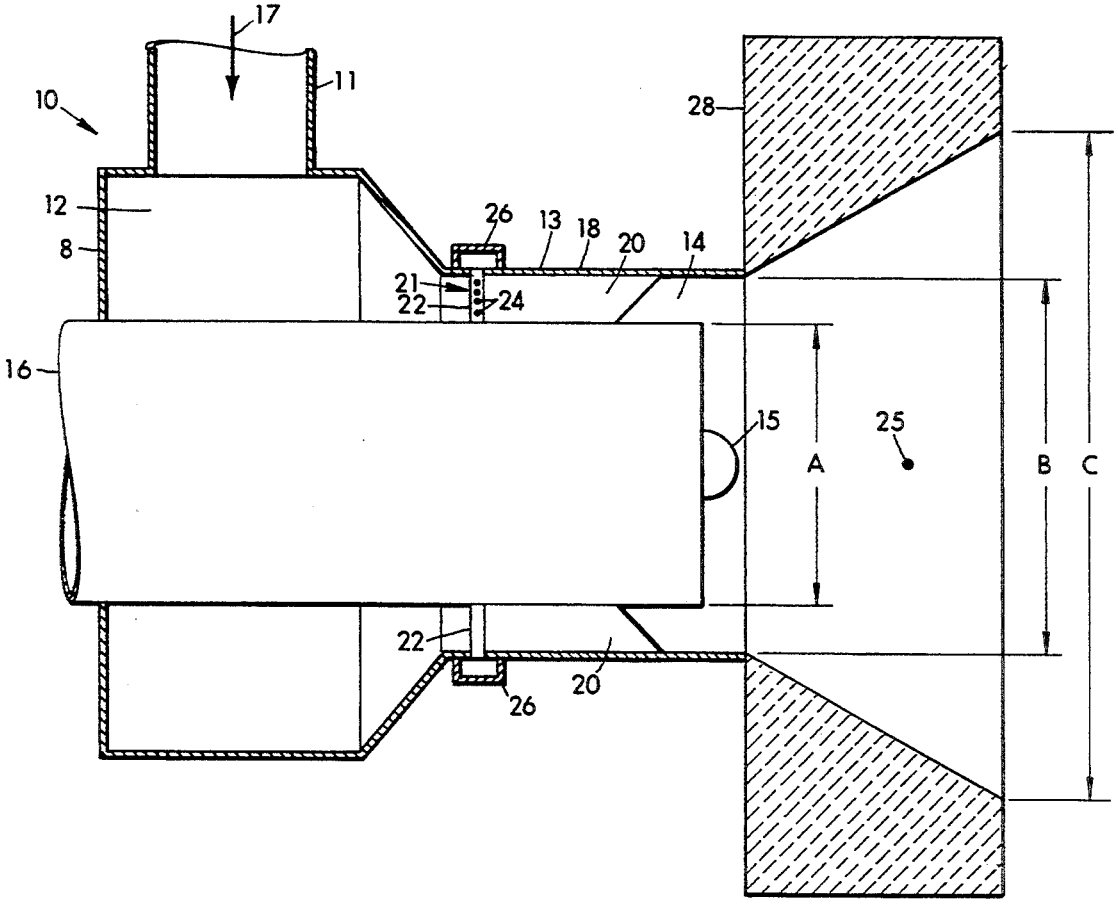
FIG. 3 is a schematic longitudinal cross-sectional view, through a first embodiment of apparatus in accordance with the present invention.

FIG. 3 is a longitudinal highly schematic view of forced burner apparatus 10 in accordance with the present invention. Apparatus 10 includes an outer shell 8 having a plenum or windbox 12 and an adjoined tubular section 13. Air and recirculated flue gases 17 are provided under positive pressure by conventional fan means (not shown) via a conduit 11 to burner windbox 12, from which they proceed into the burner throat 14. The latter is a constricted annular space defined between outer cylindrical wall 18 of section 13, and an inner coaxial cylindrical body 16. The latter functions as a bluff body, and may take the form of or include an oil gun 15 (which gives the burner both gas and oil firing capabilities); or can simply be an open or closed end tube in the case of a gas only burner.

A set of swirl vanes 20 are mounted in the throat 14. Typically the swirl vanes can be approximately twenty in number, although greater or lesser numbers of vanes can be used depending upon the burner size and specific conditions under which the burner may be operated. Swirl vanes 20 are designed to impart a specific amount of swirl (S) to the flow with a minimum pressure loss. Fuel gas injection means 21 are provided proximate swirl vanes 20. Thus at the upstream, i.e. the leading edges of each swirl vane, hollow tubes 22 are attached, each of which is provided with a series of small holes 24 which serve as ejection ports for fuel gas, e.g. natural gas. The fuel gas is fed to the series of tubes 22 by a fuel gas feed manifold 26 which extends in toroidal fashion about the axis of apparatus 10 and is connected to provide an input to each tube 22. The totality of gas injection holes in effect define a grid of injection points. The object of this arrangement is to provide extremely rapid mixing with the air/FGR mixture. The mixing is effected rapidly enough to minimize regions of fluid having a stoichiometry of less than 0.6 downstream of the ignition point. In the apparatus 10 shown, this occurs at an approximate axial point 25.

As is known in the art, an igniter is only used for start-up. Once the main flame is established, the igniter is removed and the flame is self-stabilizing. The ignition point is determined by the temperature and mass flow rate of the internal recirculation gases, which in turn is determined by the burner geometry and the amount of external FGR that is used.

The high degree of mixing should be achieved down to a molecular scale. The grid of gas injection points is designed to provide a minimum of 200 injection points per square foot of the projected area of a transverse cross-section taken through the throat 14 at the plane of the grid, with the mutual spacing of the injection points being such as to provide uniform mixing with the oxidant gases. In FIG. 3 the injection points are located to inject the gas in the direction of the tangential component of the flow imparted by the swirl vanes 20. In this approach the gas injection also acts to enhance the swirl number of the flow. The diameter (A) of the cylindrical body 16 defines the inner diameter of the swirling flow.

Figure 4:
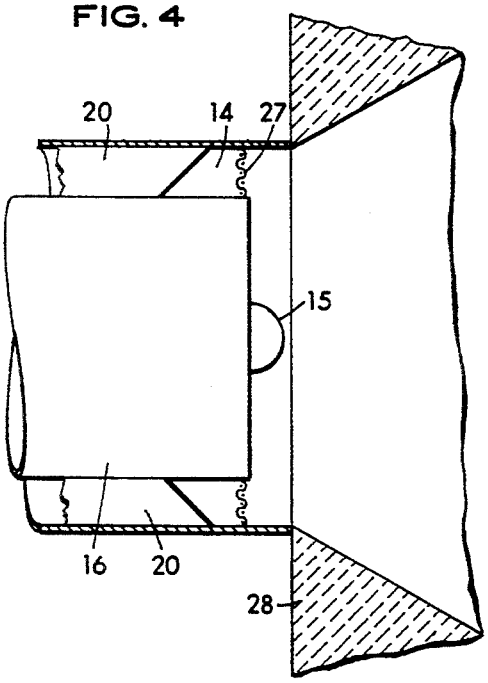
FIG. 4 is a schematic view similar to FIG. 3, but showing only sufficient of the apparatus to illustrate a modification of same in which turbulence enhancing means are provided.

A modification of the apparatus of FIG. 3 is shown in the partial view of FIG. 4. In this instance a turbulence enhancer 27 has been mounted in the throat 14 downstream of the swirl vanes 20. The turbulence enhancer may take the form of a fine mesh screen, its function being to generate fine scale mixing as the fuel/air/FGR mixture passes through the screen. In a typical instance the screen openings will be no greater than 1 mm.

Figure 5:
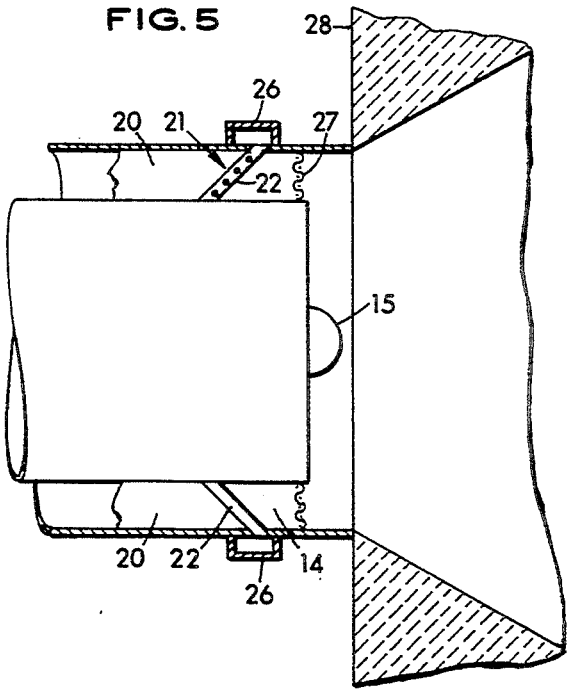
FIG. 5 is a schematic longitudinal cross-sectional view similar to FIG. 3, and showing a further embodiment of apparatus in accordance with the invention.

A further embodiment of the invention appears in FIG. 5. In this instance, it will be seen that the gas injection means 21, i.e. consisting of the same basic arrangement as aforementioned, is such that the hole carrying tubes 22 are now mounted at the trailing edge of the swirl vanes 20. In this instance again the turbulence enhancer 27, i.e. a fine screen is provided. The screen is located a minimum of 30 gas injection hole diameters downstream of the gas injection grid 21 in order to provide adequate distance for macromixing to occur. Depending upon the specific shape of the swirl vanes 20, tubes 22 can also extend along radials, i.e. the tubes would be vertically oriented as shown in FIG. 3.

The mixture of air, recirculated flue gas and fuel gas are flowed into a divergent quarl 28, which may be formed of a suitable refractory in view of the high temperature combustion taking place within such flame zone. The quarl has a sufficient diameter expansion, i.e. the ratio C/B (see FIG. 3), to provide the desired flame stability.

An isometric perspective depiction of the FIG. 5 embodiment of apparatus 10 appears in FIG. 6, which shows the relative location of the furnace windbox 12, the location of the swirl vanes 20 in the air/FGR throat 14 and the location of the turbulence enhancer 27. It should be appreciated that the turbulence enhancer need not necessarily be used with the present invention, although in many instances it will assist in providing the desired enhanced mixing.

A further embodiment of the present invention is depicted in the partial longitudinal cross-sectional schematic view of FIG. 7. This apparatus is generally similar to that of FIGS. 5 and 6 except that in this instance the gas injection means instead of or in addition to comprising tubes located just downstream of the trailing edges or just upstream of the leading edges of the swirl vanes, comprises a pair of hollow rings or torroids, which are mounted to reside within throat 14. The outer ring 30 carries a plurality of gas ejection openings, oriented to eject gas in an axial direction. The smaller hollow ring 32 similarly carries a series of ejecting holes disposed to eject gas away from the axis of apparatus 10. Thus the ejection holes on each of rings 30 and 32 direct the fuel gas toward the opposed ring, to assist in mixing. Additional rings of this type may be used in pairs or otherwise. For small burner sizes this arrangement can simplify to gas injection from holes provided at the inner and outer walls of the annular flow channel which defines the throat 14.

FIG. 7A shows a further fuel gas injector arrangement. In this instance a small section 35 is shown toward a lateral edge 37 of a swirl vane. The vane is hollow as seen at 39 and is fed fuel gas under pressure from an open end 41 connected to a gas feed manifold (not shown). The fuel gas is ejected from a plurality of holes 43 provided at the surface of the swirl vane.

Typical hole size of each injector is approximately 1/16" or smaller, and the number of injection holes will typically range from 625 to 1043 for ratios of the gas/air velocity ranging from 3 to 5. However, different gas/air velocity ratios may be used generating different numbers of injectors according to the method described below. The injection grid should be spaced uniformly in the azimuthal direction, but varied in the radial direction to give equal number of injectors per annulus cross-sectional area (i.e. the area increases with radius squared.

The injector hole size is based on the entrainment rate of the air/FGR mixture into the gas jets. For a typical case the volume of the air and FGR mixture is 15 times the volume of the air and the desired mixing distance is 4". The diameter of the gas jets can be calculated according to the entrainment rate:

$$M_e/M_o=[0.32(P_a/P_o)^{\frac{1}{2}}x/d]-1$$

$M_e$—mass entrained
$M_o$—mass of gas jet
$P_a$—density of air/FGR mixture
$P_o$—density of the gas
x—axial distance
d—diameter of the gas jet For $M_e/M_o=15$ and x=4" and $P_a/P_o=1$, the diameter of the gas jet is 0.087". The gas jet diameter should be smaller than 0.087".

The number of gas jets can be defined by the ratio of the gas/air velocity used. Typically the velocity ratio will be in the range 3/1 to 5/1 and will depend on the available gas pressure and the direction of gas injection relative to the air velocity. The number of gas injectors can be defined by the relative total area of air/FGR area to the gas area and the ratio of the gas/air injection velocity. This number is given by:

Number of gas injectors/square foot=1/(volume ratio oxidant/gas,gas/air velocity ratio.area single gas injector $ft^2$).

For an oxidant/gas ratio=15, an gas/air velocity ratio of 4 and a hole size of 1/16" the number of gas injectors per square foot of air/FGR cross-sectional area is 782. The number of injectors should consequently be at least 782.

Pursuant to a further aspect of the present invention, the dimensions of the annular region defined by the ratio of the inner diameter of the swirl vanes divided by the outer diameter of the swirl vanes, i.e. the ratio A:B in FIG. 3, is preferably in the range of 0.6 to 0.8. In addition, the product of the swirl number (S) with the quarl outlet-to-inlet ratio, i.e. the factor S.(C/B) is preferably in the range of 1.0 to 3.0 in order to assure the adequate mixing of interest to the invention. The outlet of the quarl can be shaped to provide control of the flame shape. For example, the outlet of the quarl can be parallel to the burner throat to minimize the rate of expansion of the flame in a narrow furnace. The quarl, as mentioned, can be constructed from refractory material or can form part of a water wall where water cooling is utilized.

The combination of the parameters S.(C/B) between 1.0 and 3.0 and the annular ratio of the swirling flow between 0.6 and 0.8 generates a strong internal recirculation flow far back into the quarl. This insures a sufficient supply of hot combustion gases to the mixture of gas/air and recirculated flue gas to insure a stable flame at high recirculation rates.

Figure 8:
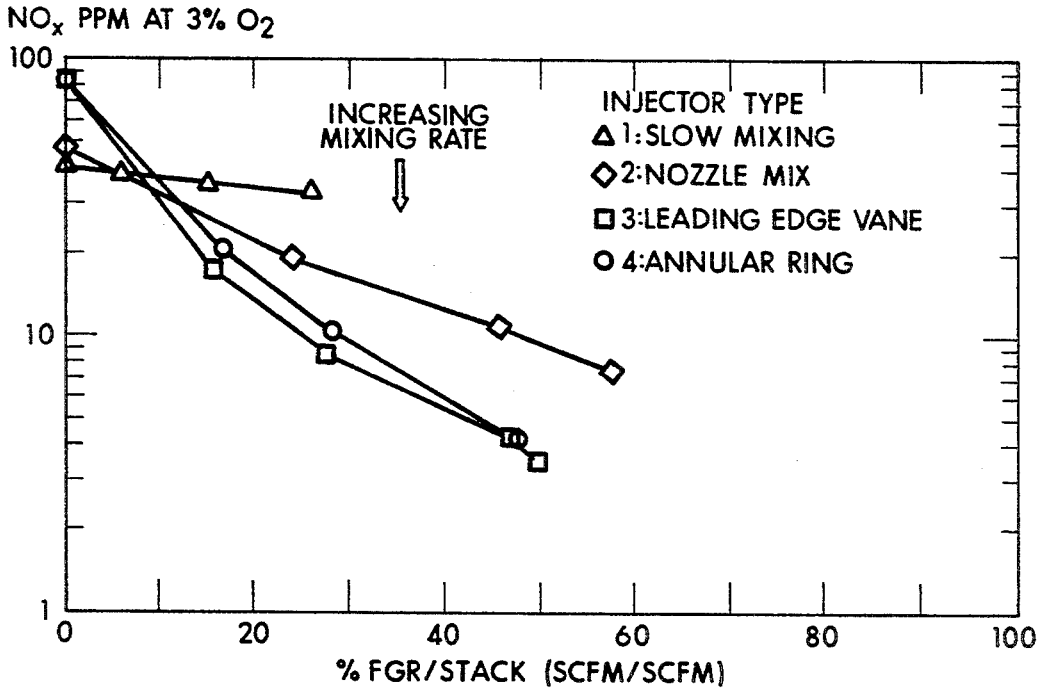
FIG. 8 is a graphical depiction showing the effect of mixing rates on $NO_x$ emissions.

Experiments were conducted with burners having geometries similar to those of FIGS. 3 through 7, in an 80 hp boiler where 3 MMBtu/hr represents full load. During the burner experiments various gas injection methods were investigated. These methods included (1) axial injection through the central recirculation zone ("slow mixing"); (2) injection of the gas into the combustion air just downstream of the burner throat using an annular injector ("nozzle mix"); (3) gas injectors attached to the leading edge of the swirl vanes as per FIG. 3; and (4) annular ring injectors as per FIG. 7. Procedures (3) and (4) are in accordance with the invention. Results from these tests are shown in FIG. 8. Without flue gas recirculation, the $NO_x$ emissions were reduced by going to slower fuel and air mixing rates. But for FGR rates greater than about 10%, the reverse became true, the faster the mixing rate the lower the $NO_x$ emissions. When the fuel/air mixing rate is slow, flue gas recirculation has only a small effect on the $NO_x$ emissions indicating that the majority of the $NO_x$ is prompt $NO_x$. The rapid mix cases (3) and (4) show a much greater effect on the $NO_x$ emissions than the more traditional nozzle mix case (2).

The data in FIG. 8 show that if unmixed pockets of gas can be eliminated downstream of the ignition point, $NO_x$ emissions can be reduced to less than 10 ppm with about 25% FGR (as compared to 50% for the nozzle mix injector). If desired, the $NO_x$ emissions can be reduced to less than 4 ppm using about 50% FGR.

Figure 9:
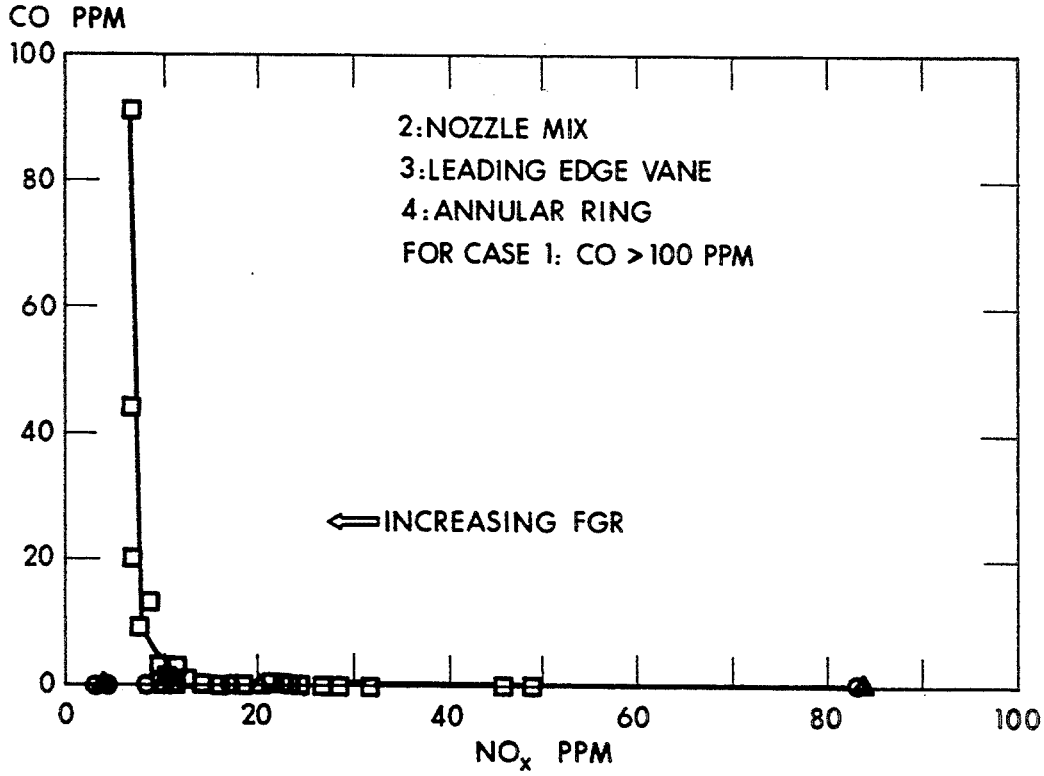
FIG. 9 is a graph showing the relationship between carbon monoxide and $NO_x$ for apparatus in accordance with the invention, as compared with conventional nozzle mix devices.

Another important advantage of the present invention is the effect on CO and other unburned combustible emissions. FIG. 9 shows the relationship between $NO_x$ and CO emissions for the tests described above. As the mixing improved and lower $NO_x$ emissions could be obtained, the CO emissions were also reduced. For the rapid mix cases (3) and (4), less than 4 ppm $NO_x$ emissions could be obtained with CO emissions less than the detection limits of the analyzer (1 ppm).

The present invention provides methods of obtaining a high degree of mixing upstream of the ignition point while maintaining a gas injection point downstream of the axial swirl vanes (i.e. the burner would effectively remain a nozzle mix burner avoiding the drawbacks of a premix burner). The method of rapid mixing is combined with a burner and quarl geometry which provides strong internal recirculation of hot combustion products to the root of the flame, and an extremely stable flame. The combination of the parameters S.(C/B) being between 1.0 and 3.0 and the annular ratio of the swirling flow between 0.6 and 0.8 provides a suitable internal recirculation pattern and the required flame stability.

Figure 10:
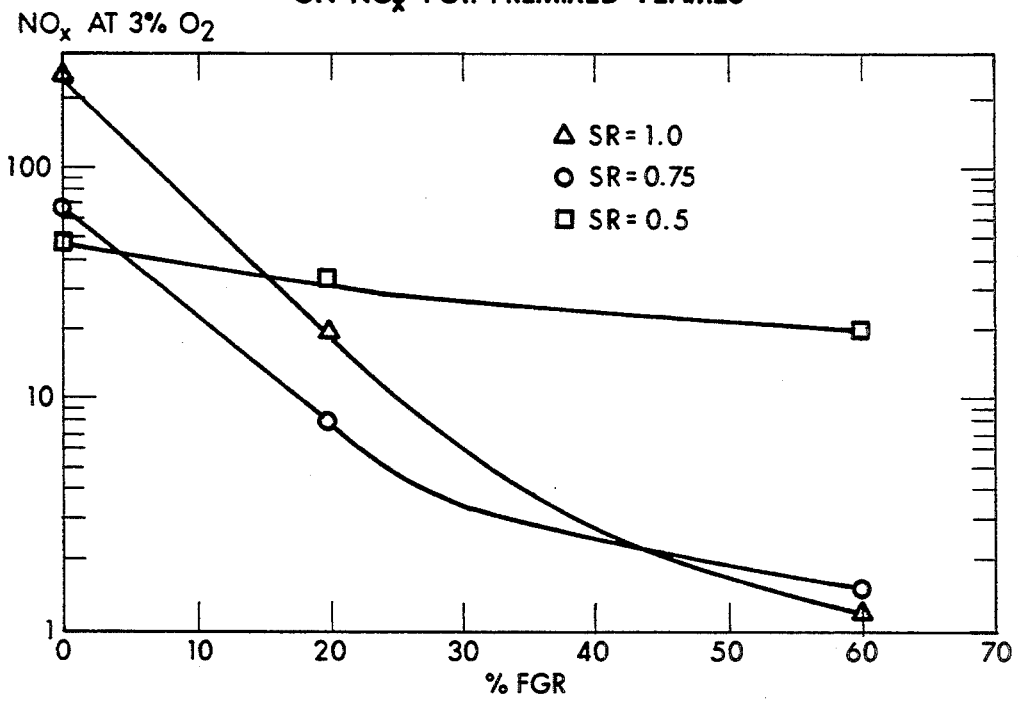
FIG. 10 is a graph depicting the calculated effect of stoichiometry on $NO_x$ for premixed flames.

If desired the rapid mixing of fuel and air may be combined with air staging to reduce $NO_x$ emissions while minimizing the amount of FGR which may be required. As shown in FIG. 10, kinetic calculations show that at an FGR rate of 20%, a reduction in $NO_x$ emissions from 20 ppmv to 8 ppmv can be achieved if rapid mix conditions can be created. FIG. 10 also shows that operations at stoichiometries of 0.5 must be avoided if prompt $NO_x$ is to be eliminated.

Figure 11:
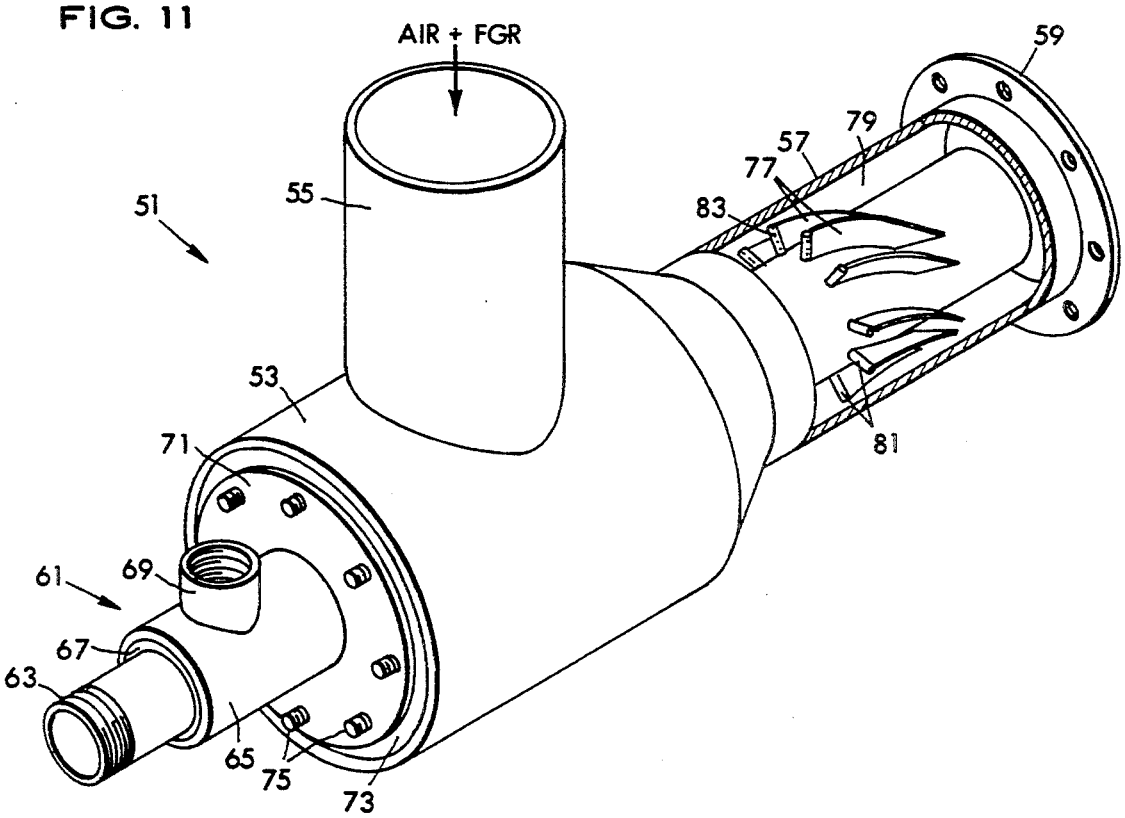
In FIG. 11 a perspective view appears of a further embodiment of burner apparatus in accordance with the present invention.
Figure 13:
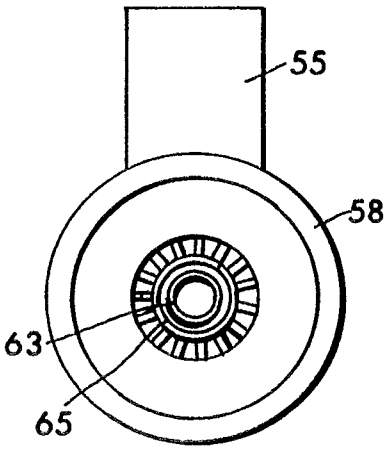
FIGS. 13 and 14 are respectively front and rear-end views of the apparatus of FIGS. 12 and 13.
Figure 14:
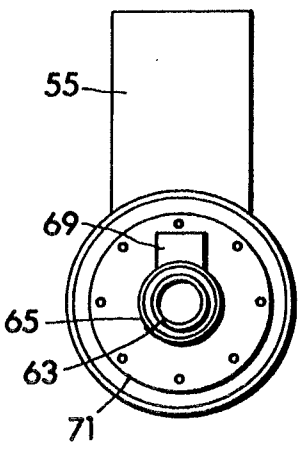

In FIG. 11 herein, an isometric perspective view appears of a further embodiment of burner apparatus 51 in accordance with the present invention. This Figure may be considered simultaneously with FIGS. 12, 13 and 14, which are respectively longitudinal cross-sectional; and front and rear end views of apparatus 51. Apparatus 51 may be compared with the apparatus 10 in FIG. 6, from which it will be seen that certain similarities are present, but also a number of differing features.

Figure 12:
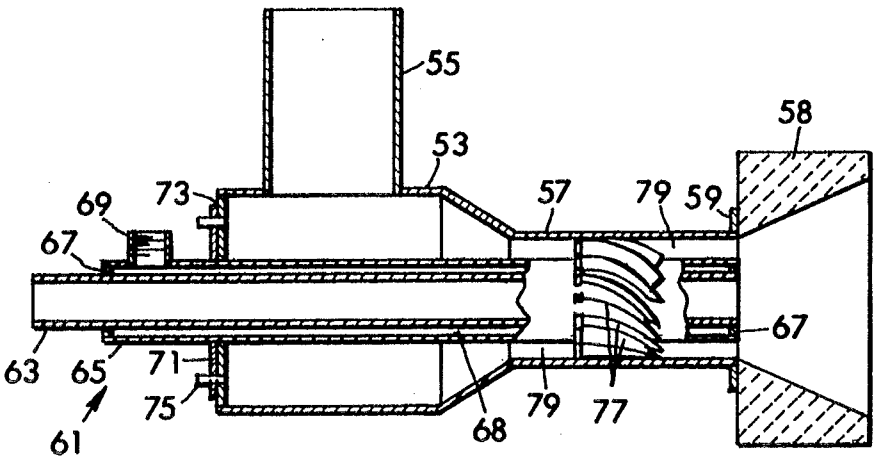
FIG. 12 is a longitudinal cross-sectional view through the apparatus of FIG. 11.

In burner apparatus 51 combustion air (which can be mixed with recirculated flue gas) is provided to the windbox 53 through a cylindrical conduit 55. Windbox 53 adjoins a tubular section 57 which terminates at a flange 59, which as in prior embodiments is secured to a divergent quarl 58 (FIG. 12). In the apparatus 10 of FIG. 3, fuel gas is provided by an external manifold 26. In the arrangement shown in FIG. 11, the inner co-axial cylindrical body 61 is comprised of a central hollow cylindrical tube 63 intended for receipt of an oil gun or a sight glass and a surrounding tubular member or cylinder 65 which is spaced from the outside wall of tube 63 and closed at each end, by closures 67. A hollow annular space 68 is thereby formed between tubular member 63 and cylinder 65, which serves as a manifold 68 for the fuel gas which is provided to such space via connector 69. The cylindrical body 61 is positioned and spaced within wind box 53 and tubular section 61 by passing through flanges, one of which is seen at 71. The latter is secured to a plate 73 at the end of the wind box by bolts 75 and suitable fasteners (not shown). This arrangement enables easy disassembly, as for servicing and the like.

In the arrangement of burner 51, a series of swirl vanes 77 are again provided in the annular space or throat 79 which is defined between tubular body 61 (specifically; between the outer wall of cylinder 65) and the inner wall of tubular member 57. At the immediately upstream end of each of the swirl vanes 77, gas injector means are provided which take the form of a plurality of tubes 81, each of which is provided with multiple holes 83, this arrangement being in such respect similar to the device shown in FIG. 3. It will be evident that the tubes 81, being hollow members, are in communication at their open one end with the interior of the gas manifold 68 defined within member 65, which therefore serves as a feed source for the fuel gas. The fuel gas is discharged in the direction of the openings 83, so that in each instance fuel is injected into the throat directly at the leading edges of the swirl vanes and in the direction of the tangential component of the flow imparted by the swirl vanes 77. Accordingly, the gas injection also acts to enhance the swirl number of the flow.

Figure 15:
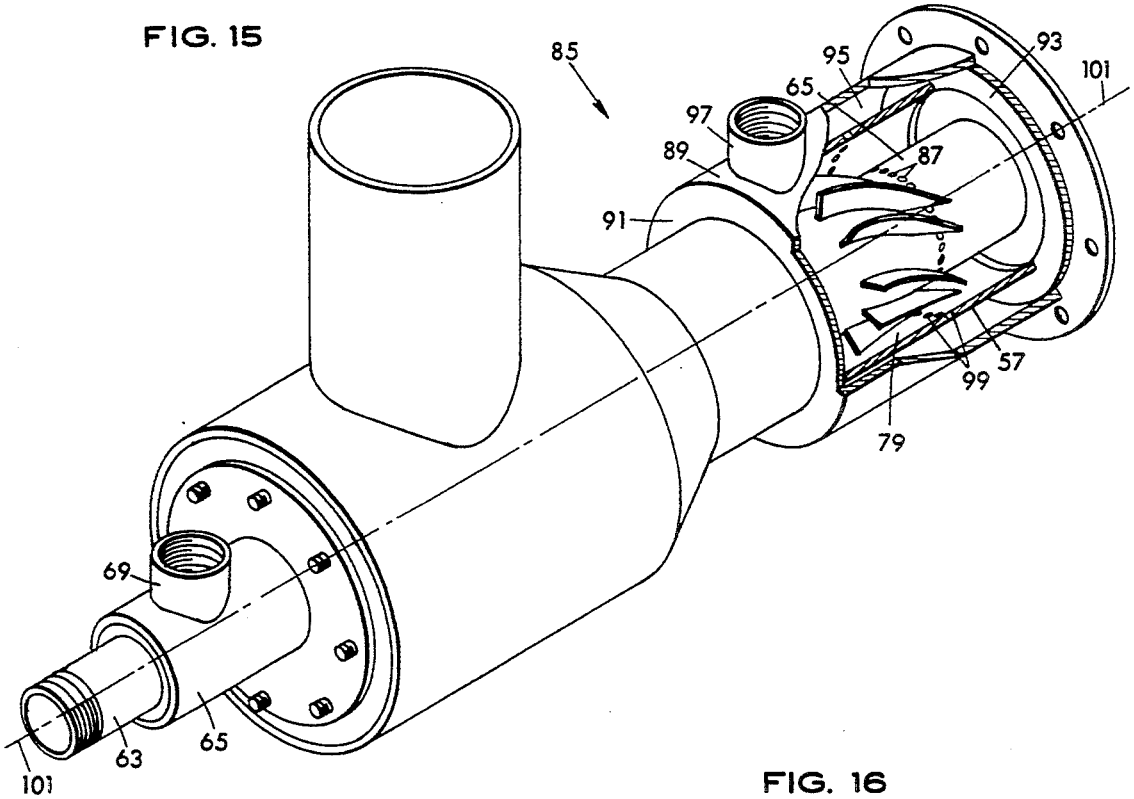
FIG. 15 is a perspective view of a further embodiment of burner apparatus in accordance with the present invention.

In FIG. 15 a further perspective view appears of burner apparatus in accordance with the invention. The apparatus 85 in FIG. 15 is in most respects similar to apparatus 51 in FIGS. 11 through 14, and identical components are identified by corresponding reference numerals. In the instance of apparatus 85, the method of fuel gas introduction is different from that shown in FIGS. 11 through 14, and in fact uses principles similar to those shown in the apparatus of FIG. 7. Specifically, it will be seen that the fuel gas introduced by connector 69 to the interior gas manifold 68 (see FIG. 12) defined between tubular member 65 and the inner tube 63, is injected into throat 79 by a series of holes or openings 87 which are disposed in a band extending circumferentially about the tubular member 65. These holes are seen to be directly adjacent and virtually contiguous to the downstream end, i.e. to the trailing edges of swirl vanes 77. Gas injection from openings 87 is seen to be in an outward radial direction with respect to the axis 101 of apparatus 85. Further, it is seen that a second gas manifold 95 is formed as an annular space surrounding tube 57, by a cylinder 89 which is closed at both ends 91 and 93. The annular gas manifold 95 is thus seen to be present between cylinder 89 and tubular member 57. An inlet for fuel gas is again provided by a connector 97. A second series of holes or openings 99 are disposed in a band about the wall of cylinder 57, so that fuel gas may be injected from manifold 95 through such openings 99. In this instance, the gas is injected radially but toward the axis 101 of the apparatus. Thus, as was discussed in connection with FIG. 7, the holes on the one hand at 99 and at the other at 87, provide opposed gas injection between the bands of holes, to produce a high degree of turbulence and mixing directly at the trailing edges of swirl vanes 77. The arrangement shown is particularly suitable where the apparatus 85 is of relatively compact dimensions.

Figure 16:
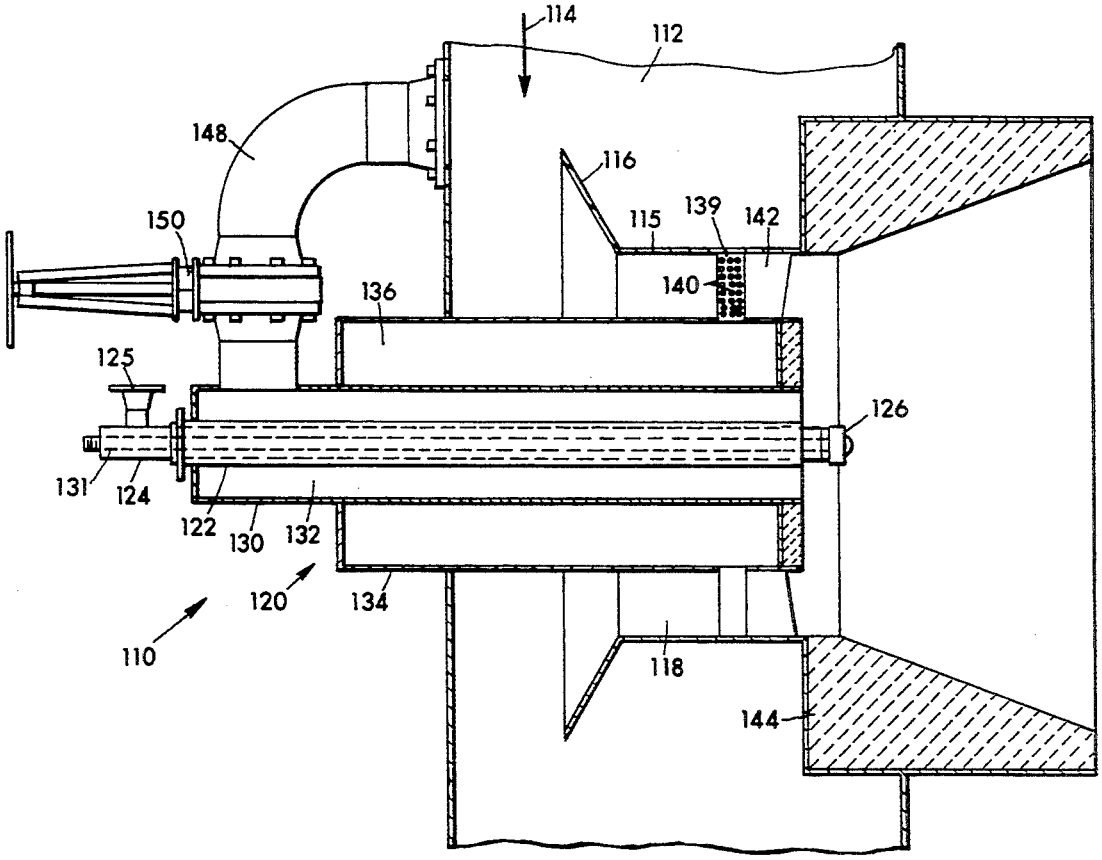
FIG. 16 is an elevational view simplified and partially in cross-section of a further embodiment of burner apparatus in accordance with the present invention.
Figure 17:
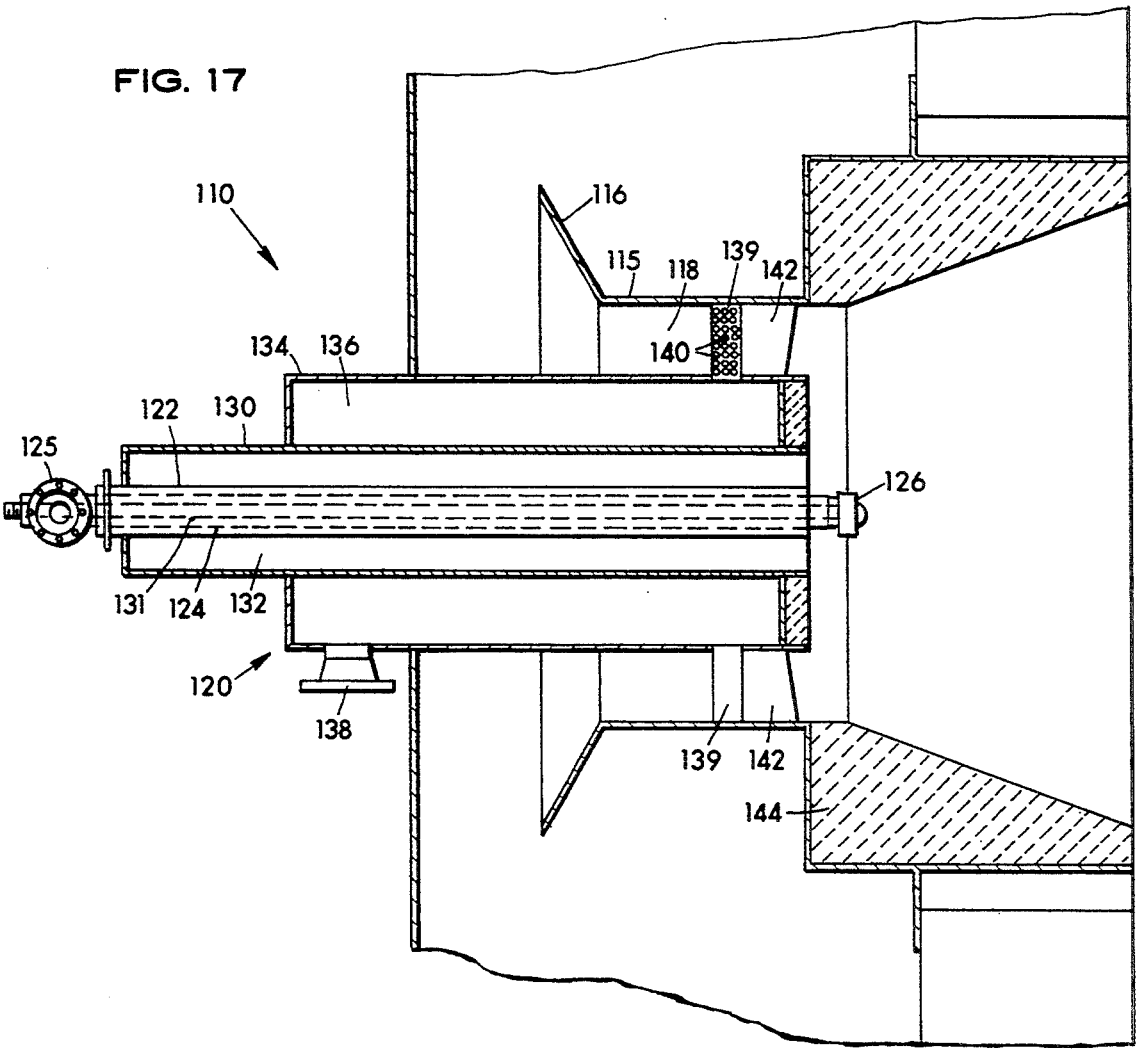
FIG. 17 is a top-plan view of the apparatus of FIG. 16 which is partially in section.

In FIGS. 16 and 17, elevational and plan views appear of further apparatus 110 in accordance with the invention. These views are somewhat simplified and schematic in nature and may be considered simultaneously in connection with this description. Windbox 112, as best seen in FIG. 16, is fed combustion air and flue gas in the direction 114 (by pressurizing means not shown). The entirety of the windbox is not shown, but is rather broken away at its upper end. The arrangement of apparatus 110 enables a more compact device than certain of the prior apparatus discussed. Specifically, it will be seen that a constricted tubular section 115 is provided, which is in direct communication with the interior of wind box 112 through the open end defined by diverging flange 116. The flange 116, while shown to diverge linearly, can also be dish-shaped to assist in air flow. Combustion air proceeds through the annular space 118 defined between tubular member 115 and the generally cylindrical body 120 mounted coaxially within said member. Cylindrical body 120 consists of a central tube 122 within which is received an oil gun 124 terminating in a nozzle 126. Oil is provided to gun 124 by port 125. Tube 122 in turn is surrounded by a spaced tubular member 130. The spacing between tube 130 and tube 122 defines an annular space 132 the function of which will be indicated below. Tube 130 is, in turn, surrounded toward its forward end by a further cylinder 134 which is closed at each end and defines within same an annular fuel receiving manifold 136. Fuel from manifold 136 is fed via a connector 138. The gas injector means in the present device 110 comprises a series of prism-like hollow members 139 which are mounted transversely to cylinder 134 and intersect and are open to the interior manifold space 136 within same. The members 139 are provided on their lateral faces with openings 140 which substantially correspond in function to the openings 83 in FIG. 11. The members 139 are directly in contact with and contiguous with the leading edges of swirl vanes 142, so that the gas is injected directly at such leading edge. As in prior embodiments, a diverging quarl 144 is provided at the outlet end of burner throat 118.

It is seen further that an elbow-shaped conduit 148 connects the interior of one side of windbox 112 to the interior annular space 132. A manually or non-manually operated gate valve 150 may be actuated to open or close a flow path between the windbox 112 and space 132. When the valve is in an open position, an air flow is provided into space 132 which then proceeds forwardly in the device and passes about the periphery of the oil nozzle 126. Steam or other actuating gas (such as compressed air) may be fed to the rear of the tube 131 to assist (as is known in the art) in spraying or atomizing the oil into the combustion volume. The air stream flow moving past nozzle 126 prevents or limits coke and ash particles from depositing on the oil gun during oil firing.

Figure 18:
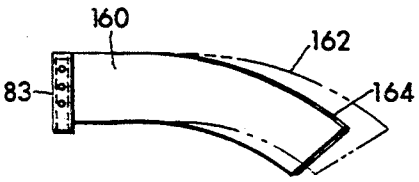
FIG. 18 is an elevational view showing details of one of the swirl vanes which may utilize in the present invention.
Figure 19:
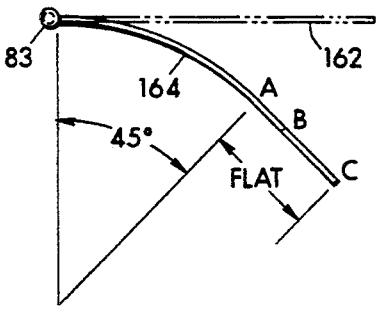
FIG. 19 is a top-plan view of the swirl vane of FIG. 18.
Figure 20:
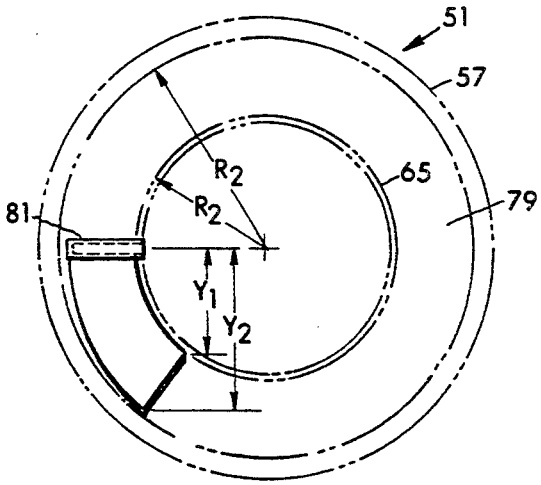
FIG. 20 is an in-view of the apparatus 51 of FIG. 11 showing certain relationships between the swirl vane and the remaining portions of the apparatus.

The details of the swirl vane constructions which are preferably used in accordance with the present invention are set forth in the views of FIGS. 18, 19 and 20. Referring first to FIG. 18, a vane 160 is shown which may be considered to be one of the vanes 77 in apparatus 51 of FIG. 11. This is representative of the swirl vanes which may be used in any of the apparatus depicted in the drawings herein. The shadow line version of the vane as seen at 162 indicates the form of the vane in plan view before it is bent to achieve a desired curvature in accordance with the invention. The vane 160 is seen to be secured, as previously discussed in connection with apparatus 51, to the injector tube 83 as, for example, by being welded to same. The corresponding plan view of the vane of FIG. 18 is seen in FIG. 19, which again shows the vane before and after the bending to achieve the desired shape for use in the invention.

The end view of FIG. 201 shows the vane in its installed position in apparatus 51. Corresponding parts as discussed in FIG. 11, are identified by corresponding reference numerals.

The burner apparatus of the invention uses the fixed curved axial swirl vanes in the burner throat 79 to impart a given swirl level to the flow. The vanes are called axial swirl vanes because of the manner in which they convert an axial flow to a swirling flow. The swirl vanes used in the burner are designed to provide the desired flow pattern with a minimum pressure drop. Additionally, the vane is shaped to simplify manufacturing using conventional metal fabricating techniques.

Swirling flows are commonly used in burners to improve flame stability and to improve fuel and air mixing. When a swirling flow is expanded, an internal recirculation zone is created which recirculates hot combustion products to incoming air and fuel, thus providing an ignition source. The objective of a swirl generator is to provide a certain level of rotation to the flow in order to provide the required amount of internal recirculation with a minimum energy requirement (pressure drop). In the burner apparatus of the invention, the swirl vanes also act as a mixing device for the gas and air/FGR mixture. When the gas is injected at the leading edge of the vane, fine scale turbulence is created as the flow acquires rotation generating the desired rapid mixing between the gas and oxidant.

Pursuant to the present invention, the leading edge of the vane is parallel to the axial flow. The fluid is accordingly slowly curved to the final angle. A constant radius of curvature is used along the surface of the curved portion of the vane (the curved portion of the vane is a section of a cylinder). This is significant in allowing the vanes to be easily manufactured using conventional rolling equipment. The swirl vane assembly is annular with an inner to outer radius $R_1/R_3$ (as shown in FIG. 20) in the range of 0.6 to 0.7. The exit angle of the vane is constant along the height of the vane producing a constant flow angle of the azimuthal to axial velocity (W/U). A straight vane section oriented at the final flow angle is attached to the trailing edge of the curved section. This is shown at ABC in FIG. 19. The straight vane section is designed to produce a constant overlap between the vanes as a function of the vane height.

Referring to FIG. 19, the vane is curved with a constant radius of curvature until the exit angle is achieved (point A). The vane then continues at a fixed angle (straight portion). The length of the straight portion varies with the vane height. In FIG. 18 the length of the straight portion of the vane along the inner tube is given by the distance from points A to B, while the length along the outer tube is given by the distance from points A to C.

The vane is curved in a circular arc with the radius of curvature given by:

$$R_c = (\textit{Overlap Factor})(6.28 \cdot R_1)/N/(1 - \cos(a)) \quad (1)$$

where:

Overlap factor=(100+ % vane overlap)/100

$R_1$=inner tube radius

N=total number of vanes, and a=vane exit angle

A typical % overlap to be used in equation (1) is 50%, but may be any number greater than about 20%. A typical exit angle is 45 degrees but may vary in the range 30 to 60 degrees.

Because the use of a constant radius of curvature results in a reduction of the vane overlap for the curved portion of the vane with increasing height of the vane between $R_2$ and $R_1$, a straight section is added to the vane. The shape of the straight section of the vane which continues at the vane exit angle, a, is determined according to the following criteria.

Along the inner surface of the vane, the surface attached to $R_1$, the straight vane length is a small fraction of the curved vane length (5 to 10% of the curved vane length would be a typical fraction). The length of the straight vane along the outer surface is determined such that the distance $Y_2$, FIG. 20, is the same as the distance $Y_1 \cdot R_2/R_1$ along the inner surface. The length of the straight vane section at any intermediate radius $R_n$ is determined such that $Y_n$ is equal to $Y_1 \cdot R_n/R_1$.

The vane 160 may be fabricated by several techniques. These include cutting out the flat vane shape and following the curved portion of the vane; cutting out the flat vane shape and stamping the final shape; and casting the blade directly into the final shape.

While the present invention has been particular set forth in terms of specific embodiments thereof, it will be understood in view of the present disclosure, that numerous variations on the invention are now enabled to those skilled in the art, which variations yet reside within the scope of the present teaching. Accordingly, the invention is to be broadly construed and limited only by the scope and spirit of the claims now appended hereto.

What is claimed is:

1. A forced draft burner apparatus for burning a gaseous fuel while producing low levels of $NO_x$, CO and hydrocarbon emissions; comprising:

an outer shell including a windbox and a constricted tubular section in fluid communication therewith;

a generally cylindrical body mounted in said shell coaxially with and spaced inwardly from said tubular section;

an annular flow channel being defined between said body and the inner wall of said tubular section, said channel constituting a throat for oxidant gases provided thereto from said windbox, and having a downstream outlet end for said gases;

means for providing a flow of said oxidant gases to said throat from said windbox;

a divergent quarl being adjoined to said outlet end of said throat and defining a combustion zone for said burner;

a plurality of curved axial swirl vanes being mounted in said annular flow channel to impart swirl to said oxidant gases flowing downstream in said throat;

fuel gas injection means being provided in said annular flow channel proximate to said swirl vanes for injecting said gas into the flow of oxidant gases at a point upstream of said outlet end; and said fuel gas injection means comprising a plurality of spaced gas injectors, each being defined by a gas ejection hole and means to feed the gas thereto; the ratio of the number of gas ejection holes to the transverse cross-sectional area of the annular flow channel which is fed fuel gas by said injector means being at least 200/ft$^2$.

2. Apparatus in accordance with claim 1, further including turbulence enhancing means mounted in said throat at at least one of the upstream or downstream sides of said swirl vanes for inducing fine scale turbulence into the flow to promote microscale mixing of the oxidant and fuel gases prior to combustion at said quarl.

3. Apparatus in accordance with claim 2, wherein said turbulence enhancing means comprises a screen.

4. Apparatus in accordance with claim 3, wherein said screen openings are no greater than 1 mm.

5. Apparatus in accordance with claim 1, wherein the product of the swirl number S and the quarl outlet to inlet diameter ratio C/B is in the range of 1.0 to 3.0.

6. Apparatus in accordance with claim 1, in which said gas injectors are located at the leading edges of said swirl vanes, and inject said fuel gas in the direction of the tangential component of the flow imparted by the swirl vanes.

7. Apparatus in accordance with claim 1, in which said gas injectors are located at the trailing edges of said swirl vanes, and inject said fuel gas in the direction of the tangential component of the flow imparted by the swirl vanes.

8. Apparatus in accordance with claim 1, wherein said gas injectors are disposed on a plurality of hollow concentric rings which are mounted in said throat downstream of said swirl vanes.

9. Apparatus in accordance with claim 8, comprising at least two spaced rings, the holes on the outer ring facing toward the axis of said conduit and the holes on the inner ring facing away from said axis, whereby to produce a flow of gas from each ring toward the other.

10. Apparatus in accordance with claim 1, wherein said gas injectors are openings disposed in circumferential bands in the opposed walls abounding said annular flow channel; said apparatus having gas manifolds on the sides of said walls non-adjacent the annular flow channel, for feeding gas to said openings; whereby to produce a flow of gas from the openings in each band toward the openings in the other band.

11. Apparatus in accordance with claim 1, wherein said swirl vanes are hollow and fuel gas feed means are provided for feeding said gas to the hollow vanes, said gas injector means comprising holes in the surfaces of said vanes which communicate with the hollow interiors.

12. Apparatus in accordance with claim 1, wherein the ratio of the inner diameter (A) to the outer diameter (B) of the swirl vanes, is in the range of 0.6 to 0.8.

13. Apparatus in accordance with claim 1, wherein said gas injection means comprises a plurality of injectors disposed along one or both of the leading or trailing edges of said swirl vanes; and a plurality of further injectors disposed on a plurality of concentric rings which are mounted in said throat downstream of said swirl vanes.

14. Apparatus in accordance with claim 1, wherein said generally cylindrical body spaced inwardly from said tubular section includes an oil injector, which thereby provides the burner both gas and oil firing capabilities.

15. Apparatus in accordance with claim 14, wherein said oil injector comprises an oil feed tube extending along the axis of said generally cylinder body; and a nozzle at the distal end of said tube extending from the outlet end of said throat; a hollow cylinder surrounding said tube and being open at the end toward said nozzle; and said apparatus including means for diverting air from said windbox to said hollow cylinder to provide an air stream preventing coke and ash particles from depositing on the oil gun during oil firing.

16. In a forced draft burner of the type which includes an annular throat of outer diameter B, having an inlet connected to receive a forced flow of air and recirculated flue gases, and an outlet adjoined to a divergent quarl; a plurality of curved stationary axial swirl vanes mounted in the annular throat to impart swirl to the gases flowing downstream in the throat; and an ignition point defined at an axial location in said quarl; an improved method for injecting gaseous fuel to enable extremely low $NO_x$, CO and hydrocarbon emissions from the burner, comprising:

injecting the gaseous fuel into said throat at an axial coordinate which is spaced less than B in the upstream direction from the axial coordinate at which quarl divergence begins; and providing sufficient mixing at and downstream of the point of injection that the gaseous fuel, air, and recirculated flue gases are well-mixed down to a molecular scale at the point of ignition, by injecting said gaseous fuel proximate to said swirl vanes from a plurality of gas ejection holes, the ratio of the number of gas ejection holes to the transverse cross-sectional area of the annular throat being at least $200/ft^2$.

17. In a forced draft burner of the type which includes an annular throat of outer diameter B, having an inlet connected to receive a forced flow of air and recirculated flue gases, and an outlet adjoined to a divergent quarl; a plurality of curved stationary axial swirl vanes mounted in the annular throat to impart swirl to the gases flowing downstream in the throat; and an ignition point defined at an axial location in said quarl; the improvement enabling extremely low $NO_x$, CO and hydrocarbon emissions from the burner, comprising:

means for injecting the gaseous fuel into said throat proximate to said swirl vanes at an axial coordinate which is spaced less than B in the upstream direction from the axial coordinate at which quarl divergence begins; said means comprising a plurality of gas ejection holes, the ratio of the number of gas ejection holes to the transverse cross-sectional area of the annular throat being at least $200/ft^2$;

whereby sufficient mixing is provided at and downstream of the point of injection that the gaseous fuel, air, and recirculated flue gases are well-mixed down to a molecular scale at the point of ignition.

18. A forced draft burner apparatus for burning a gaseous fuel while producing low levels of $NO_x$, CO and hydrocarbon emissions; comprising:

an outer shell including a windbox and a first hollow cylinder having an outlet, and an inlet which is in fluid communication with said windbox;

a second hollow cylinder mounted in said shell coaxially with and spaced inwardly from said first cylinder;

an annular flow channel being defined between said first and second cylinder, said channel constituting a throat for oxidant gases provided thereto from said windbox, and having a downstream outlet end for said gases;

means for providing a flow of said oxidant gases to said throat from said windbox;

a divergent quarl being adjoined to said outlet end of said throat and defining a combustion zone for said burner;

a plurality of curved axial swirl vanes being mounted in said annular flow channel to impart swirl to said oxidant gases flowing downstream in said throat;

fuel gas injection means being provided in said annular flow channel proximate to said swirl vanes for injecting said gas into the flow of oxidant gases at a point upstream of said outlet end; and said fuel gas injection means comprising a plurality of spaced gas injectors, each being defined by a gas ejection hole and means to feed the gas thereto; the ratio of the number of gas ejection holes to the transverse cross-sectional area of the annular flow channel which are fed fuel gas by said injector means being at least $200/ft^2$.

19. Apparatus in accordance with claim 18; further including a third hollow cylinder mounted coaxially within and spaced from said second cylinder, the annular space between said second at third cylinder comprising a manifold for said fuel gas, and said fuel injector means being in communication with said manifold.

20. Apparatus in accordance with claim 18, wherein said swirl vanes are mounted with their leading edges parallel to the axial flow of fuel and oxidant gases, and have a constant radius of curvature along the curved portion of the vanes, whereby said curved portion is a section of a cylinder.

21. Apparatus in accordance with claim 18, wherein the product of the swirl number S and the quarl outlet to inlet diameter ratio C/B is in the range of 1.0 to 3.0.

22. Apparatus in accordance with claim 18, in which said gas injectors are located at the leading edges of said swirl vanes, and inject said fuel gas in the direction of the tangential component of the flow imparted by the swirl vanes.

23. Apparatus in accordance with claim 18, in which said gas injectors are located at the trailing edges of said swirl vanes, and inject said fuel gas in the direction of the tangential component of the flow imparted by the swirl vanes.

24. Apparatus in accordance with claim 18, wherein said gas injectors are disposed in a plurality of concentric rings in said throat downstream of said swirl vanes.

* * * * *